US007942763B2

(12) United States Patent
Zaccaria

(10) Patent No.: US 7,942,763 B2
(45) Date of Patent: May 17, 2011

(54) BASKETBALL RIM VISUAL TARGET DEVICE

(76) Inventor: David L. Zaccaria, Price, UT (US)

( * ) Notice: Subject to any disclaimer, the term of this patent is extended or adjusted under 35 U.S.C. 154(b) by 0 days.

(21) Appl. No.: 11/348,849

(22) Filed: Feb. 7, 2006

(65) Prior Publication Data

US 2007/0129183 A1 Jun. 7, 2007

Related U.S. Application Data

(60) Provisional application No. 60/741,575, filed on Dec. 2, 2005.

(51) Int. Cl.
*A63B 69/00* (2006.01)
*A63B 63/08* (2006.01)

(52) U.S. Cl. ..... 473/447; 473/422

(58) Field of Classification Search ..... 473/447, 473/448, 422–426, 479, 480, 449; 273/331–335
See application file for complete search history.

(56) References Cited

U.S. PATENT DOCUMENTS

| | | | | | |
|---|---|---|---|---|---|
| 647,487 | A | * | 4/1900 | Frazier | 482/87 |
| 689,344 | A | | 12/1901 | Yoerger et al. | |
| 755,689 | A | | 3/1904 | McFadden | |
| 1,782,254 | A | * | 11/1930 | Breidenbach | 273/453 |
| 2,045,972 | A | * | 6/1936 | Tompkins | 482/89 |
| 2,697,603 | A | | 12/1952 | Haines | |
| 3,023,001 | A | * | 2/1962 | Gourdouze | 473/430 |
| 3,050,305 | A | * | 8/1962 | Bachand et al. | 473/430 |
| 3,157,962 | A | * | 11/1964 | Bonnelly | 446/247 |
| 3,602,504 | A | | 8/1971 | Chapman et al. | |
| 3,630,521 | A | * | 12/1971 | Lingbeek et al. | 473/426 |
| 3,650,530 | A | | 3/1972 | Gantz | |
| 4,244,569 | A | * | 1/1981 | Wong | 473/447 |
| 4,506,886 | A | * | 3/1985 | Lamb, Sr. | 473/447 |
| 4,627,611 | A | | 12/1986 | Kauffman | |
| 4,836,539 | A | | 6/1989 | Knapp | |
| 4,915,381 | A | * | 4/1990 | Hackett | 473/447 |
| 5,156,394 | A | * | 10/1992 | Deal | 473/485 |
| 5,338,026 | A | * | 8/1994 | Kregel | 473/147 |
| 5,390,912 | A | | 2/1995 | Silagy | |
| 5,575,481 | A | * | 11/1996 | Lovetere et al. | 473/430 |
| 5,603,495 | A | | 2/1997 | Noveck | |
| 5,916,046 | A | * | 6/1999 | Allred et al. | 473/430 |
| 6,190,270 | B1 | | 2/2001 | Barry | |
| 6,312,350 | B1 | * | 11/2001 | White | 473/489 |
| 6,773,365 | B2 | * | 8/2004 | Wilson | 473/449 |
| 2007/0135239 | A1 | * | 6/2007 | Manix et al. | 473/448 |

* cited by examiner

*Primary Examiner* — Mitra Aryanpour
(74) *Attorney, Agent, or Firm* — Workman Nydegger

(57) ABSTRACT

A visual target device includes a target object and a suspension member or cord. The visual target device can be suspended within a basketball rim to provide a point of focus for a basketball player while shooting. The target object is smaller than the basketball rim such that the shooter has a more precise target to aim at. The target object is typically suspended from the rim at or below the level of the rim such that the target object does not prevent the basketball from entering the rim. The target object can be suspended from the rim by an elastic cord or other elastic means such that the target object can be pushed aside as the basketball enters the rim. The suspension cord can include a vertical component for properly positioning the target object below the rim.

18 Claims, 2 Drawing Sheets

BASKETBALL RIM VISUAL TARGET DEVICE

RELATED APPLICATIONS

This application claims the benefit of U.S. Provisional Patent Application Ser. No. 60/741,575, filed Dec. 2, 2005, entitled "Basketball Rim Visual Target Device," the disclosure of which is incorporated herein in its entirety.

BACKGROUND OF THE INVENTION

1. The Field of the Invention

This invention is in the field of sports and health fitness. Specifically, the present invention relates to a visual training device for improving basketball skills.

2. The Relevant Technology

Shooting a basketball with precision is an exercise that requires great skill. For many basketball players an initial level of proficiency can be achieved in a relatively short period of time. However, a premium is placed on developing consistently high percentages of shots made from various places on a basketball court. It is often difficult for basketball players to obtain high percentages.

One problem with shooting a basketball is the difficulty of focusing. Most basketball players focus on the basketball rim. However, the basketball rim is large and extends around the entire perimeter of the target. A basketball player typically has two options. The first option is to aim for the rim as a whole. However, this practice generally leads to poor precision since the rim is larger than the target. Alternatively, the basketball player can aim for a particular part of the rim. This option may give the basketball player a smaller target, but it requires the basketball player to mentally partition the rim into a smaller target. Moreover, the portion of the rim that serves as the target changes as the shooter moves radially about the rim.

The lack of a good target on a basketball rim can cause poor focusing by the shooter. Shooters that repeatedly practice shots while having poor focus develop muscle memory with a range of precision that is wider than the target (i.e., the basketball hoop). This poor precision due to poor focusing and aiming leads to missed shots.

SUMMARY OF THE INVENTION

The present invention relates to a visual target device positioned within a basketball rim that gives the user a target for shooting the basketball. The visual target device includes a target object (e.g., a small ball such as a tennis ball) that is smaller than the basketball rim such that the shooter has a more precise target to aim at.

The target object can be any size or shape so long as it is small enough to fit within the center of the rim. Preferably, the target object is substantially smaller than the rim, but large enough to be seen by a user while shooting from the basketball court.

Preferably, the target object is substantially centered within the rim. Positioning the object in the center of the basketball rim ensures that the target will be properly aligned no matter where the shooter is positioned on the basketball court.

The target object is suspended from the rim or backboard using any mechanism that allows the target object to be resiliently displaced from the center of the rim to allow the basketball to pass thereby. In one embodiment, the target object is suspended from the rim using an elastic cord.

The target object is typically suspended from the rim at or just below the level of the rim. Positioning the target object at or just below the rim can prevent the target object from interfering with the basketball's entry into the basketball rim.

During shooting practice, a basketball player focuses on the object within the basketball hoop. The target object trains the user to focus on a precise target. During a game situation, the user can visualize the target. Furthermore, repeated use of the target object during practice improves the muscle memory of the shooter. More precise shooting during practice leads to more precise shooting during a game.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF EXEMPLARY EMBODIMENTS

The present invention relates to a visual target device that is suspended within a basketball rim in order to provide a point of focus for a basketball player while shooting. The visual target device includes a target object that is smaller than the basketball rim such that the shooter has a more precise target to aim at. The target object is typically suspended from the rim at or below the level of the rim such that the target object does not prevent the basketball from entering the rim. The target object can be suspended from the rim by an elastic cord or other elastic means such that the target object can be pushed aside as the basketball enters the rim.

Figure 1:
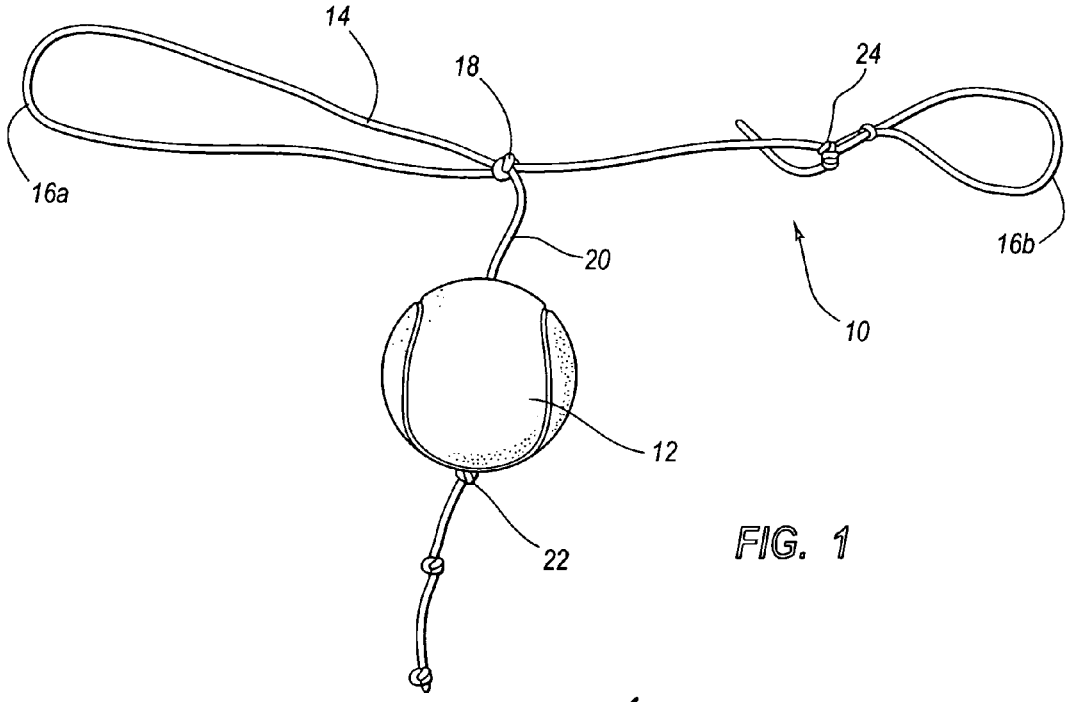
FIG. 1 is a perspective view of an exemplary basketball rim visual target device according to one embodiment of the present invention.

As shown in FIG. 1, in one embodiment, a visual target device 10 includes a target object 12 and a suspension cord 14. Suspension cord 14 is connected to target object 12 and is configured to be connected to a basketball rim such that target object 12 can be suspended at or below the level of a basketball rim.

Target object 12 can be any physical object that is smaller than a standard basketball rim and can provide a point of focus for a shooter. Target object 12 can also be a color that is easily viewed such as bright or fluorescent colors. Target object 12 can be made from a resilient material such that repeated hits from a basketball minimize wear.

In an exemplary embodiment, target object 12 can be a tennis ball. A tennis balls are suitable as a target object since they are easy to see, small, lightweight, and relatively inexpensive. Furthermore, as explained below, an elastic cord can be easily passed through a tennis ball to connect the ball to suspension cord 14 without destroying the integrity of the tennis ball.

Figure 3:
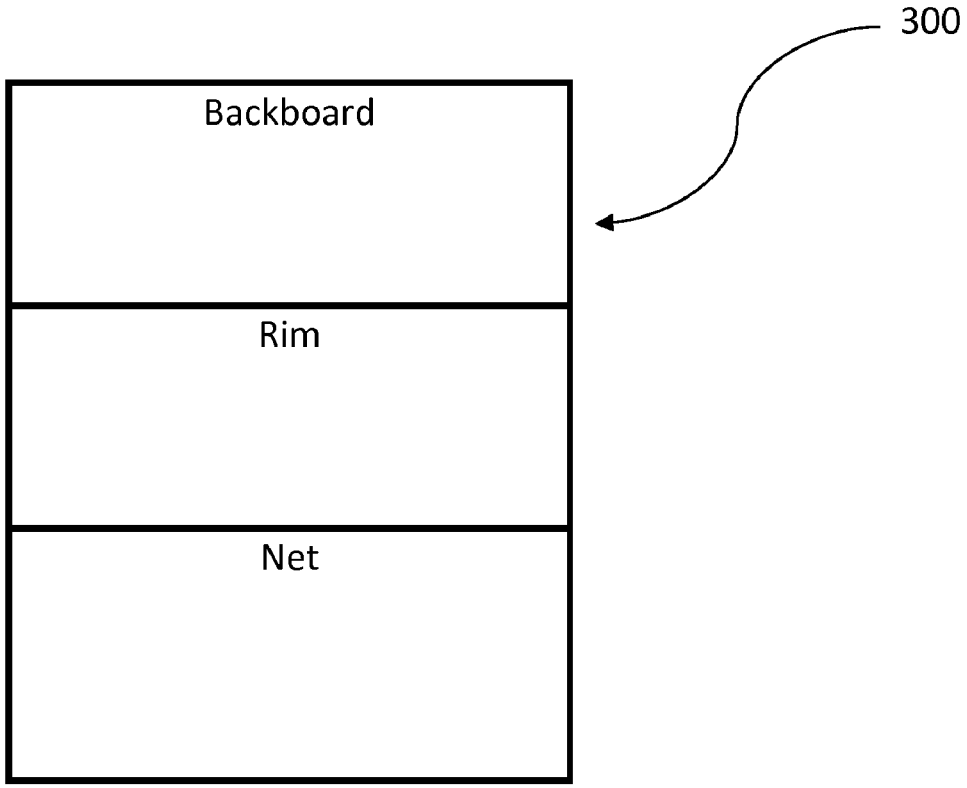
FIG. 3 is a block diagram illustrating an association between a backboard, rim, and net.

Suspension cord 14 is made of an elastic material that is sufficiently sturdy to hold target object 12 near the level of the rim and sufficiently elastic to allow a basketball to push the suspension cord aside as it passes through a basket ball rim. Suspension cord 14 has connectors 16*a* and 16*b* such that device 10 can be attached to a basketball rim. In an exemplary embodiment, connectors 16*a* and 16*b* are loops that can be connected to the eyelets of a basketball rim. The connectors 16*a* and 16*b* connect to the basketball rim in a similar fashion as a basketball net and can be connected simultaneously with a net. FIG. 3 is a block diagram 300 illustrating an association of a backboard, rim, and net. Suspension cord 14 can have any type of connector including clamps, tie strings and other known connection means. In an alternative embodiment, the connectors can be a spring or other elastic mechanism that allows the target focusing device to extend.

Target object 12 is typically connected at the center 18 of suspension cord 14. Connecting the target object in the middle of suspension cord 14 ensures that target object 12 is positioned in the center of the rim when suspension cord 14 is connected to the rim. However, if suspension cord 14 is connected to other parts of the basketball stand, target object 12 can be positioned along suspension cord 14 at any location that places target object 14 in a desired location relative to the basketball rim.

As shown in FIG. 1, suspension cord 14 can include an upward cord 20 (also referred to as a (vertical component") that extends from the center 18 of suspension cord 14. Upward cord 20 allows target object 12 to be positioned a desired distance below the level of the rim. For example, the target object can be suspended 0 to about 10 inches (0-25 cm) below the rim, more preferably from about 1 inch to about 5 inches (2.5 cm and 13 cm) below the rim. The height of target object 12 can also be partially controlled by the slack in the crosswise portion of suspension cord 14. However, in some embodiments excess slack is not desirable because the tension in the cord maintains the attachment to the basketball rim.

In an exemplary embodiment, the height of the target object can be adjusted by the user. For example, the upward cord 20 can have several small knots that will hold the tennis ball at a particular spot on the upward cord 20 but will still allow the user to pull the tennis ball up or down to adjust the height.

Suspending the focusing device at or below the rim can be advantageous as it minimizes interference of the focusing device on the basketball entering the rim. By placing the focusing device at or below the rim, the focusing device does not interfere with the trajectory of the basketball until after the basketball has entered the rim. In addition, positioning the target object below the rim can prevent the rim from blocking the basketball player's view of the target object.

As shown in FIG. 1, in one embodiment, suspension cord 14 can be made from one continuous elastic cord. The cord is threaded through a hole in target object 12 and secured by tying a knot 22. Connector 16*a* is formed by tying a second knot at the center 18. Connector 16*b* is formed by tying a third knot 24 at another end of the cord. Knot 24 can be made such that the overall width of the target device 10 (i.e., the distance between connector 16*a* and connector 16*b*) can be adjusted. Adjusting the overall width can increase or decrease the tension on suspension cord 14, thereby allowing the user to adjust how much force is required for the basketball to displace the target device from the center of the rim. In one embodiment, the knot at center 18 can also be adjustable such that the target device can be adjusted to the center when knot 24 is adjusted (i.e., tightened or slackened).

In a preferred embodiment, the tension on cord 14 is as high as possible while allowing the weight of a standard-sized basketball to displace the target device from the center of the rim. After the basketball displaces the target device, the contraction of the resilient cord rapidly repositions the target object in the center of the basketball rim.

Suspension cord 14 and target object 12 can be connected using any mechanism. Cord 14 can be threaded through target object 12, wrapped around target object 12, connected using an adhesive, and/or connected using any other known connection mechanism.

Figure 2:
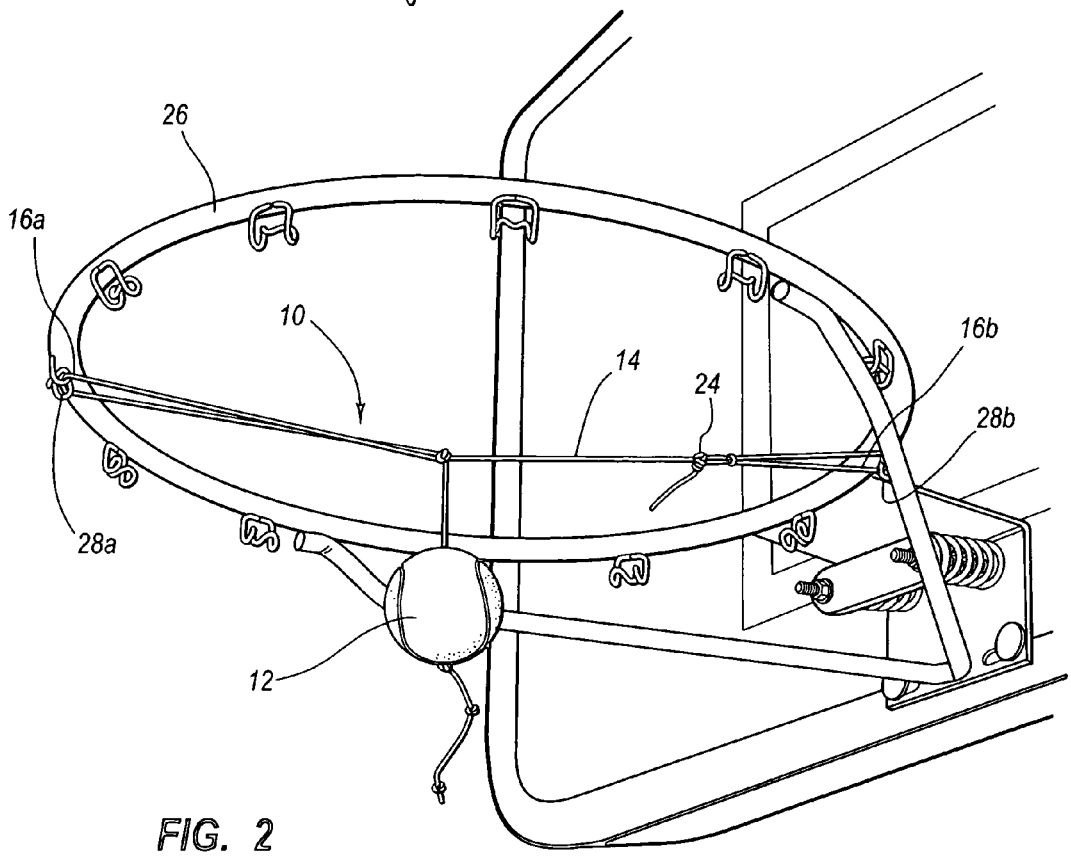
FIG. 2 is a photograph showing the basketball rim visual target device of FIG. 1 suspended on a basketball rim.

FIG. 2 shows device 10 attached to a basketball rim 26. Basketball rim 26 has a plurality of eyelets (collectively referred to as eyelets 28). Connectors 16*a* and 16*b* are looped around eyelets 28*a* and 28*b*, respectively. Connecting the visual target device 10 to the eyelets can be advantageous because the connection point is close to the level of the rim 26, but does not interfere with the surface of the rim where the basketball contacts the rim 26. The visual target device 10 is preferably connected to rim 26 such that target object 12 is positioned in the center of the rim. With the target object 12 in the center of the rim 26, the target object 12 is properly positioned no matter where the shooter is positioned on the court.

The visual target device 10 of the present invention can be used with or without a net. In addition, the device 10 can be used with a ball return device. When using a ball return device, the user can make repeated shots from the same location to improve muscle memory. However, the device 10 can also be used without a ball return device.

By hanging the ball on the rim such that the ball is in approximately the center, or in exactly the center of the rim and hanging therebelow, the basketball player has a point of focus that he can focus on when shooting during practice. The shooter can form a mental image of the ball during practice so that in a game situation, he or she can remember that mental image and attempt to shoot the ball at the same place.

By practicing with the device of the present invention, a shooter develops muscle memory that is more accurate than muscle memory developed without a focus target. By continually practicing and focusing on a certain point, the basketball player has mentally ingrained a point of focus that should be hit upon while shooting the ball. By having that point of focus in mind during a game situation, the player will be more naturally inclined to shoot the ball at the focus point. Optionally, the distance of the ball from the rim can be adjusted by adjusting the size of the loops and/or by using a different size string, or through a variety of different methods.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A basketball rim targeting device assembly, comprising:

a basketball rim comprising a substantially circular opening having an upper edge, a lower edge, and a plurality of eyelets;

a basketball net attached to the plurality of eyelets; and a visual targeting device connected to the basketball rim, the visual targeting device including, an elastic suspension cord having a connector on each end thereof, each connector being attached to an eyelet of the basketball rim;

a target object connected to the suspension cord and positioned such that the center of the target object is substantially centered in the rim and within the region defined by the net;

whereby the elastic suspension cord of the visual targeting device is substantially below a horizontal plane defined by the upper edge of the basketball rim to minimize interference of the visual targeting device with a basketball's trajectory until after the basketball has entered the rim, the suspension cord having sufficient length such that the suspension cord spans the diameter of the rim, the suspension cord being elastic such that a basketball can pass through the rim by stretching the suspension cord;

wherein the center of the target object is suspended below the suspension cord and the basketball rim; and wherein the suspension comprises a vertical component.

2. A visual targeting device as in claim 1, wherein the center of the target object is suspended between 0 cm and 25 cm below the horizontal plane of the basketball rim.

3. A visual targeting device as in claim 1, wherein the center of the target object is suspended between 2.5 and 13 cm below the horizontal plane of the basketball rim.

4. A visual targeting device as in claim 1, wherein the target object has a position of the target object along the vertical component that is adjustable.

5. A visual targeting device as in claim 1, wherein the target object comprises a tennis ball.

6. A visual targeting device as in claim 5, wherein the suspension cord is threaded through a hole in the target object to connect the target object thereto.

7. A visual targeting device as in claim 1, wherein the connectors on each end of the elastic suspension cord are loops that are strung on the eyelets of the basketball rim.

8. A visual targeting device as in claim 1, wherein the suspension cord is made from a single cord.

9. A visual targeting device as in claim 1, wherein the target object comprises a rubber material.

10. A basketball rim targeting device assembly, comprising:

a basketball rim comprising a substantially circular opening having an upper edge, a lower edge, and a plurality of eyelets, wherein the assembly is configured to allow a basketball to pass through the substantially circular opening;

a basketball net attached to the plurality of eyelets;

an elastic suspension cord connected to the basketball rim so as to span the diameter thereof and pass substantially through the center thereof, wherein the suspension cord comprises a vertical component having a length in a range from about 2.5 cm to about 13 cm; and a target object attached to the vertical component of the suspension cord, the target object being positioned substantially in the center and below a horizontal plane defined by the upper edge of the basketball rim, the vertical component positioning the target object within the basketball net, wherein the elasticity of the suspension cord allows a basketball to pass through the rim by stretching the suspension cord and then causes the suspension cord to automatically return the target object to the center position.

11. A visual targeting device as in claim 10, wherein the suspension cord is suspended from the eyelets.

12. A visual targeting device as in claim 10, wherein the target object comprises a tennis ball.

13. A method for using a basketball target focusing device, comprising:

providing a visual target device comprising a suspension cord having a horizontal component and a vertical component and a target object connected to the vertical component of the suspension cord;

providing a basketball rim comprising a substantially circular opening having an upper surface, a lower surface, and a plurality of eyelets attached to the lower surface;

connecting the visual target device to the basketball rim by looping a first end of the horizontal component of the suspension cord on a first eyelet and looping a second end of the horizontal suspension cord on a second eyelet that is opposite the first eyelet so as to center the horizontal suspension cord in the center of the basketball rim, whereby the elastic suspension cord and the target object are each substantially below a horizontal plane defined by the upper edge of the basketball rim to minimize interference of the visual target device with a basketball's trajectory until after the basketball has entered the rim;

adjusting the position of the target object along the vertical component relative to the basketball rim from a first position that is between about 2.5 cm to about 13 cm below the horizontal plane of the basketball rim to a second position that is also between about 2.5 cm to about 13 cm below the horizontal plane of the basketball rim, whereby the target object is substantially centered in the rim and suspended below the elastic suspension cord within the region defined by the net in both the first and the second positions; and shooting a basketball through the rim.

14. A method as in claim 13, wherein the target object comprises a rubber ball.

15. A method as in claim 14, further comprising connecting the suspension cord to the target object by threading the suspension cord through the rubber ball.

16. A visual targeting device as in claim 1, wherein the basketball rim has 12 eyelets and the cord is attached to any two opposing eyelets so that the target object is substantially in the center of the rim.

17. A visual targeting device as in claim 10, wherein the vertical component of the suspension cord comprises a cord that is tied into a plurality of knots that are positioned between about 2.5 cm to about 13 cm below a horizontal plane of the basketball rim, wherein the knots provide a plurality of positions to where the target object can be selectively positioned.

18. A method as in claim 15, wherein the vertical component of the suspension cord comprises a cord that is tied into a plurality of knots and the rubber ball in a first position is positioned on a first knot of the plurality of knots and in the second position the rubber ball is moved to a second position on a second knot.

* * * * *